United States Patent [19]

Dreiling

[11] 4,420,197

[45] Dec. 13, 1983

[54] GUIDE MEANS FOR SLIDING DRAWERS

[76] Inventor: Sebastian E. Dreiling, 2040 Conejo La., Fullerton, Calif. 92633

[21] Appl. No.: 259,412

[22] Filed: May 1, 1981

[51] Int. Cl.[3] ..... A47B 88/00; F16C 21/00

[52] U.S. Cl. ..... 312/330 R; 312/341 R; 312/348; 308/3.8

[58] Field of Search ..... 312/330 R, 333, 348, 312/341 R, 341 NR; 308/3.6, 3.8

[56] References Cited

U.S. PATENT DOCUMENTS

| | | | |
|---|---|---|---|
| 2,587,691 | 3/1952 | Brewer | 312/348 |
| 3,139,313 | 6/1964 | Rule | 312/348 |
| 3,365,261 | 1/1968 | Gutner | 312/330 R |
| 3,375,051 | 3/1968 | Anderson | 312/330 R |
| 3,384,431 | 5/1968 | Dargene | 312/341 R |
| 3,387,907 | 6/1968 | Wall | 312/348 |
| 3,702,717 | 11/1972 | Gutner | 308/3.6 |
| 3,926,492 | 12/1975 | Gutner | 312/348 |
| 4,125,297 | 11/1978 | Mertes | 312/348 |
| 4,305,625 | 12/1981 | Gutner et al. | 312/330 R |

FOREIGN PATENT DOCUMENTS

| | | | |
|---|---|---|---|
| 379715 | 8/1964 | Switzerland | 312/341 R |

*Primary Examiner*—Victor N. Sakran

*Attorney, Agent, or Firm*—Francis X. LoJacono

[57] ABSTRACT

A guide means for sliding drawers having a roller carriage adapted to be affixed to the rear of a drawer, wherein the roller carriage is slidably mounted to a longitudinal track member defining a center guide system which is positioned and secured between the front and rear of a fixed structure, such as a cabinet. The carriage is provided with a roller positioned rearwardly of the carriage, so as to be freely supported in the track and to provide lateral stability. The roller carriage comprises a substantially rectangular frame structure which is attached to the bottom of the drawer, and includes a plurality of shoe members, the track passing between the frame structure and the shoe members. The track includes a restraint member to engage the roller, thus causing frictional engagement between the shoe members and the track, when the drawer is to be removed from the track.

1 Claim, 4 Drawing Figures

GUIDE MEANS FOR SLIDING DRAWERS

BACKGROUND OF THE INVENTION

1. Field of the Invention

This invention relates generally to a drawer-guide system having a central guide track, and more particularly to a guide means to allow free longitudinal movement of the drawer and control the lateral movement thereof with respect to the track.

2. Description of the Prior Art

There are many types of drawer-slide control devices which use or employ a central guide bar or track. That is, various cabinets, desks and like fixtures include one of several guide systems wherein a central track is mounted between the front and rear walls of the fixture, whereby a guide member is supported thereon and secured to the drawer. However, many of these known devices have features that restrict their use, or they do not provide a positive means to control the lateral movement of the drawer as it is opened and closed. Also, many guide systems are so designed that a separate restraint means must be used, thus creating additional installation problems.

Some guide systems, however, do include different methods of preventing a drawer from disengaging from its track when the drawer is fully opened, but most of these methods or members make it very difficult to remove and/or replace drawers from the fixture or cabinet.

As an example of the prior art, U.S. Pat. No. 4,125,297 discloses a drawer slide which is mounted to the rear underside of a pull drawer. In this invention, the inner surfaces of the side walls are arranged to continuously engage the cabinet guide rail for proper alignment of the drawer. The stop means comprises an integrally formed depending tongue member which is adapted to engage a detent formed in the guide rail.

Thus, it can be seen that wear becomes an inherent problem with known guide systems. However, the following disclosure and description of the present invention will show and teach a guide means that overcomes this as well as the other above-mentioned difficulties.

SUMMARY AND OBJECTS OF THE INVENTION

The present invention comprises an improved guide means for sliding drawers wherein a central track is employed therewith. The guide means includes a roller carriage having a frame structure formed to be secured to the rear bottom portion of a drawer, and to be freely and slidably mounted to the central track, the frame being located above the track. A plurality of integrally formed shoe members are positioned below and adjacent the track, whereby the shoes can frictionally engage the track when the drawer is being removed. The carriage further includes a roller or wheel which is positioned rearwardly of the carriage and drawer.

Hence, it is an important object of the present invention to provide an improved guide means that overcomes the existing problems found in the prior art.

Another object of the invention is to provide an improved guide system that incorporates a central track, wherein the carriage includes a rearwardly disposed roller or wheel so as to be received in the longitudinal recess of the track. The location of the roller prevents lateral movement of the drawer, and is arranged to prevent frictional contact between the carriage and the track during the normal back-and-forth sliding of the drawer.

Still another object of the invention is to provide a guide means of this character wherein the roller is further positioned to engage a restraint member formed in the forward end of the track, in order to cause the frictional shoe members of the carriage to engage the track for two distinct purposes—one being to prevent the inadvertent separation of the drawer from the track when the drawer is fully opened, and the other being to allow the drawer to be removed in a restraining manner whereby the roller must pass over the restraining member, and cause frictional engagement between the shoe members and the track.

It is another object of the present invention to provide an improved slidable drawer-guide mechanism that has few, if any, parts that engage the track to cause wear on the parts.

It is still another object of the invention to provide a device of this character that is relatively simple to install and inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
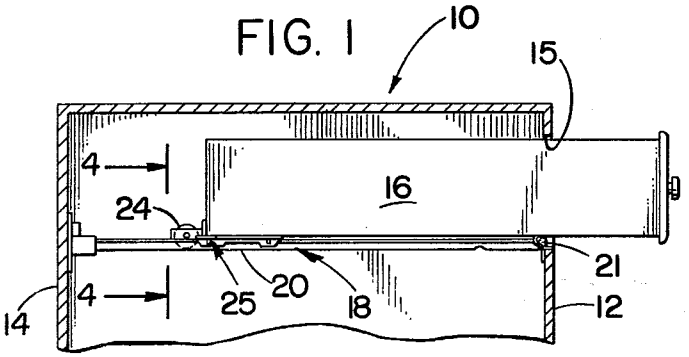
FIG. 1 is a pictorial cross-sectional view of a cabinet having a drawer therein, showing the guide mechanism attached to the drawer and supported by a centrally disposed longitudinal track.

Referring more particularly to FIG. 1, there is shown a fixed support structure defining a typical cabinet or the like, generally indicated at 10, having a front wall 12 and a rear wall 14, the front wall 12 having an opening 15 formed therein to receive drawer 16. The drawer 16 is shown as being slidably supported by a drawer-guide system, designated generally at 18.

The guide is a single-track system which comprises a single longitudinally disposed track 20 suspended between the front and rear cabinet walls 12 and 14, respectively. Also included are rollers 21 affixed adjacent the bottom of opening 15, the drawer being supported at the forward end thereof and suspended above the track 20, whereby the drawer itself does not engage directly with track 20.

Track 20 is formed having oppositely positioned outwardly inclined side walls 22, and a bottom wall 23, defining an elongated channel arranged to receive roller 24 of the roller carriage, designated at 25. Side walls 22 are further provided with flange members 26 which project laterally outward. The bottom wall 23 of track 20 is provided with a pair of spaced longitudinal ribs 28 which define a central recess 30, the width of recess 30 being substantially equal to the width of roller 24. Thus, roller 24 cannot move laterally within the channel of track 20.

Figure 2:
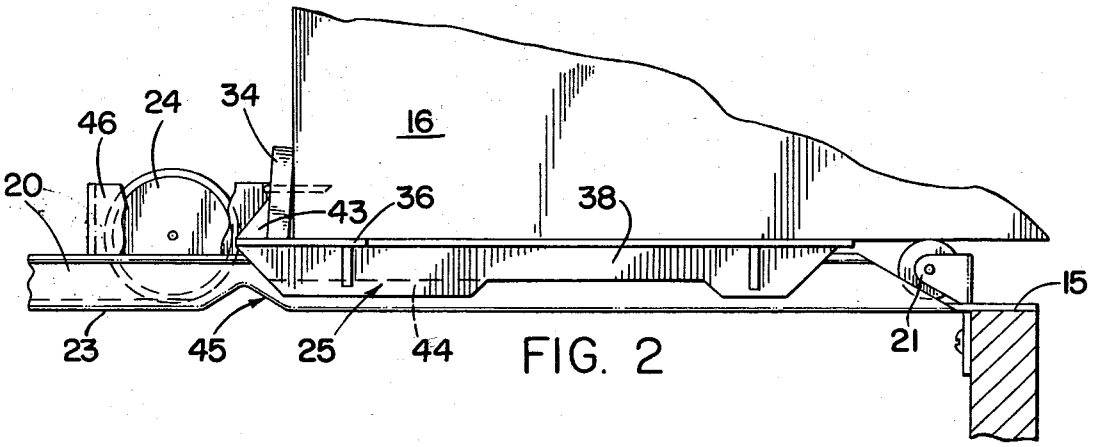
FIG. 2 is an enlarged side-elevational view of the roller carriage, with the drawer in a fully extended open position.

Roller carriage 25 comprises a flat-surfaced frame structure 32 which is directly attached to the bottom of drawer 16 adjacent the rear thereof. Frame structure 32 is constructed having a transverse brace member 34 integrally formed on the upper surface thereof, the brace member 34 being inclined forwardly so as to snugly abut the rear wall of drawer 16, as seen in FIG. 2. The structure is further constructed having laterally extending arm members 36 to provide a more stable support for the drawer, the transverse brace member 36 being positioned above the extended arms.

Figure 3:
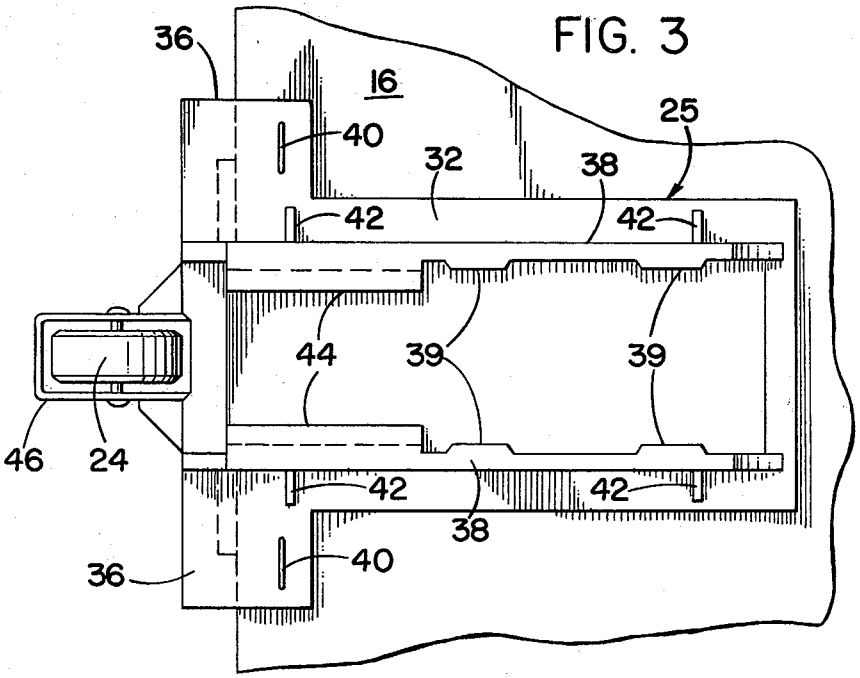
FIG. 3 is a bottom-plan view of the roller carriage, without the track shown therein.
Figure 4:
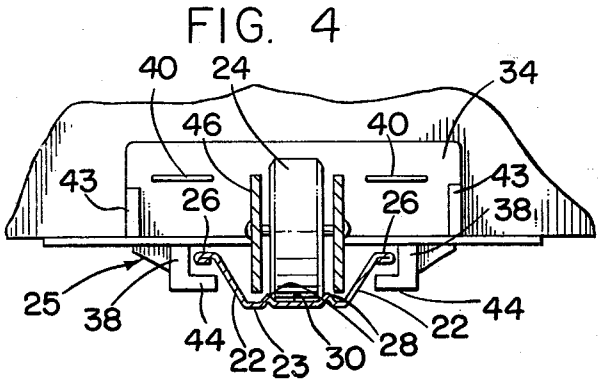
FIG. 4 is an enlarged cross-sectional view taken substantially along line 4—4 of FIG. 1.

The lower portion of frame structure 32 includes depending side walls 38 which are spaced apart sufficiently to freely receive track 20 therebetween. The inner surface of each side wall 38 is provided with alignment means having at least one guide-rib projection 39. The guide-rib projections 38 are oppositely arranged to engage the longitudinal edges of the respective flange members 26 of track 20, as shown in FIGS. 3 and 4. This arrangement provides a means to stabilize the longitudinal movement of drawer 16.

It should be noted that any suitable means can be used to attach the carriage to drawer 16. However, staples 40 are preferred, the staples being attached through the transverse brace member 36 and through the bottom of arm members 36.

It is further contemplated that carriage 25 will be constructed from a suitable plastic material—wherein gusset members 42 may be provided to reinforce the side walls 38, and gusset members 43 may be provided to reinforce brace member 34.

Adjacent the rear of side walls 38, there are formed two inwardly extended projections 44 which will hereinafter be referred to as friction shoes 44. These shoes project inwardly so as to be positioned under track flanges 26, as seen in FIG. 4; but they do not normally engage the flanges. The shoes define a restraint means which frictionally engage the longitudinal flanges only when the drawer is about to be removed from the cabinet.

Accordingly, as the drawer is fully extended to an open mode, roller 24 will engage stop means 45 formed in the bottom wall 23 of track 20. In FIG. 2, stop means 45 is shown as a raised ramp located adjacent the front end of track 20. Thus, as roller 24 engages ramp 45, the carriage and drawer will lift—whereby frictional shoes 44 press against flange members 26, thus preventing drawer 16 from being removed without force, and thus avoiding accidental dislodging.

Roller 24 is secured to carriage 25 and is rotatably supported in a rearwardly projecting bracket 46, bracket 46 being integrally formed as part of carriage 25. Hence, it is important to note that the position of roller 24 with respect to the frictional shoes 44 locates the lateral flanges 26 of track 20 between frame structure 32 and shoes 44, so that they are free—whereby the rear of drawer 18 is freely supported between roller 24, and the front is supported by rollers 21 located at the bottom of opening 15. (See FIG. 2.)

The distance between flanges 26 and shoes 44 should be slightly less than the height of ramp 45. When drawer 16 is to be removed, sufficient forward pressure must be exerted to overcome the restraining force. That is, as the drawer is pulled forwardly, the rearward roller 24 rides up the ramp 45, at which time shoes 44 frictionally engage the respective flanges 26 until roller 24 passes over ramp 45. The reverse is true when the drawer is to be reinserted into the cabinet.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. An improved guide means for sliding drawers, comprising:

an elongated track defined by a channel having a pair of oppositely disposed longitudinal edge flanges and a longitudinal recess formed in the bottom of said channel, said recess being defined by a pair of spaced-apart longitudinal rib members projecting upwardly from said bottom of said channel;

a carriage having a substantially rectangular frame structure having a transverse brace member, whereby said frame structure is secured to the bottom of said drawer and said brace member is secured to the rear of said drawer, said frame structure including oppositely disposed depending side walls;

a roller mounted rearwardly of said carriage and said drawer, and adapted to be received in said recess of said track between said longitudinal rib members to provide lateral stability to the sliding drawer, said roller being supported in a rearwardly extended bracket integrally formed with said frame structure;

stop means formed in said track and positioned to be engaged by said roller, said stop means comprising a raised ramp formed in said bottom of said track adjacent the forward end of said track;

restraint means comprising a pair of inwardly projecting shoe members integrally formed below said frame structure so as to be positioned below said flanges of said track, whereby said flanges pass through said carriage without engaging said frame structure or shoe members, until said drawer is to be removed from said track and said roller engages said raised ramp; and alignment means comprising at least one pair of guide-rib projections formed on each inner side of said depending side walls of said frame structure, whereby said oppositely disposed projections are arranged to engage the longitudinal edges of said respective flange members of said track.

* * * * *